US007911401B2

(12) United States Patent
Yoshino et al.

(10) Patent No.: US 7,911,401 B2
(45) **Date of Patent: *Mar. 22, 2011**

(54) EARPHONE ANTENNA AND WIRELESS DEVICE INCLUDING THE SAME

(75) Inventors: Yoshitaka Yoshino, Tokyo (JP); Minoru Oozeki, Kanagawa (JP); Toshiyuki Imagawa, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/654,916

(22) Filed: Jan. 8, 2010

(65) Prior Publication Data

US 2010/0141538 A1 Jun. 10, 2010

Related U.S. Application Data

(63) Continuation of application No. 10/547,385, filed as application No. PCT/JP2004/001484 on Feb. 12, 2004, now Pat. No. 7,671,813.

(30) Foreign Application Priority Data

Mar. 7, 2003 (JP) ..... 2003-061844

(51) Int. Cl.
*H01Q 1/12* (2006.01)

(52) U.S. Cl. ..... 343/718; 343/702

(58) Field of Classification Search ..... 343/718, 343/850, 859, 860, 865, 702; 455/575.1, 455/569.1

See application file for complete search history.

(56) References Cited

U.S. PATENT DOCUMENTS

| | | | | |
|---|---|---|---|---|
| 4,041,497 | A | 8/1977 | Palmaer | |
| 7,236,137 | B2 | 6/2007 | Yoshino et al. | |
| 7,671,813 | B2 * | 3/2010 | Yoshino et al. | 343/718 |
| 2003/0174100 | A1 | 9/2003 | Ogawa et al. | |

FOREIGN PATENT DOCUMENTS

| | | |
|---|---|---|
| JP | 57-206102 | 12/1982 |
| JP | 59-108348 | 7/1984 |

(Continued)

OTHER PUBLICATIONS

Japanese Office Action; Application No. 2003-061844; Dated Apr. 10, 2007.

International Search Report dated Aug. 31, 2004.

International Search Opinion dated Aug. 31, 2004.

*Primary Examiner* — Douglas W Owens
*Assistant Examiner* — Dieu Hien T Duong
(74) *Attorney, Agent, or Firm* — Rader, Fishman & Grauer PLLC

(57) ABSTRACT

An earphone antenna is provided that can eliminate high-frequency adverse effects on a wireless device transmitted from a human body via an earphone. The earphone antenna can ensure receiver sensitivity required for a signal in a wide frequency range without any sensitivity control operation and can transmit audio signals from a television receiver to an earphone unit. Two pairs of audio/high-frequency signal lines (8La), (8Lb), (8Ra), and (8Rb) corresponding to the left and right earphone units (12L) and (12R) are connected to a balun (4). Terminals of the two pairs of audio/high-frequency signal lines remote from the balun are connected to the left and right earphone units (12L) and (12R) via loading coils (LLa), (LLb), (LRa), and (LRb). The Terminals of the two pairs of audio/high-frequency signal lines remote from the balun are further connected to each other by a pair of conductive lines (20*a*) and (20*b*). The loading coils (LLa), (LLb), (LRa), and (LRb) have low impedance for a fundamental frequency and have high impedance for blocking a specific frequency higher than the fundamental frequency. In addition, the two pairs of audio/high-frequency signal lines (8La), (8Lb), (8Ra), and (8Rb) are used as transmission means for transmitting audio signals to the left and right earphone units (12L) and (12R).

4 Claims, 6 Drawing Sheets

FOREIGN PATENT DOCUMENTS

| | | |
|---|---|---|
| JP | 06-022331 | 1/1994 |
| JP | 10-056325 | 2/1998 |
| JP | 10-084209 | 3/1998 |
| JP | 2001-036330 | 2/2001 |
| JP | 2002-017426 | 1/2002 |
| JP | 2002-246816 | 8/2002 |

* cited by examiner

EARPHONE ANTENNA AND WIRELESS DEVICE INCLUDING THE SAME

CROSS REFERENCE TO RELATED APPLICATIONS

This is a Continuation Application of U.S. patent application Ser. No. 10/547,385, filed Jul. 20, 2006, which is based on a National Stage Application of PCT/JP04/01484, filed Feb. 12, 2004, which in turn claims priority from Japanese Application No. 2003-061844, filed on Mar. 7, 2003, the entire contents of which are incorporated herein by reference.

TECHNICAL FIELD

The present invention relates to a so-called earphone antenna that is connected to a wireless device to produce (output) sound from the wireless device and whose cord, is used as an antenna and, in particular, to an earphone antenna that provides a high receiver sensitivity over a wide frequency range without a sensitivity control operation or a reception-frequency switching operation and that is not affected by a human body. The present invention also relates to a wireless device including the earphone antenna.

BACKGROUND ART

In general, simple earphones have been widely used for antennas of wireless devices for receiving high frequency radio waves. Alternatively, conductive lines in wireless device bodies have been used for antennas of wireless devices. However, these antennas are difficult to provide sufficient receiver sensitivity. Accordingly, a loop antenna has been proposed as disclosed in, for example, Japanese Unexamined Patent Application Publication No. 10-84209. In such an antenna, a loop antenna is attached to a neck strap of a wireless device and an inductance element is connected to the loop antenna in parallel so that the aperture surface of the loop antenna is perpendicular to a human body surface.

However, this loop antenna does not take into consideration of an earphone. Therefore, the antenna has a disadvantage in that a signal line of the antenna is separated from a signal line of the earphone. Accordingly, Japanese Unexamined Utility Model Registration Application Publication No. 6-22331 discloses an earphone antenna in which signal lines to the earphone and an antenna are integrated into a helmet.

The antenna disclosed in, for example, the above-described Japanese Unexamined Patent Application Publication No. 10-84209 does not take into consideration of the integration of an earphone at all, which is a problem.

The known earphone antenna in which a signal line for transmitting an audio signal to an earphone and an antenna are integrated has a disadvantage in that a human body significantly affects a wireless device via the antenna since the earphone is in direct contact with the human body, thereby significantly decreasing the stability of the reception.

This problem also occurs in radio receivers. Additionally, this problem is more noticeable in, for example, portable liquid crystal display TVs (television receivers) that receive television broadcast radio waves having reception frequencies higher than that of the radio broadcast waves. However, effective countermeasures to the problem have not been developed yet.

Additionally, when receiving a television broadcast having a wide frequency range, it is difficult to maintain sufficient receiver sensitivity over the wide frequency range.

That is, so-called portable liquid crystal display TVs (television receivers) need to receive high frequency signals in a very wide frequency band such as 90 to 770 MHz. More specifically, in frequency bands for a television broadcast in Japan, a frequency band of 90 to 108 MHz (1 to 3 CH) and a frequency band of 170 to 222 MHz (4 to 12 CH) are used for the VHF range, and a frequency band of 470 to 770 MHz (13 to 62 CH) is used for the UHF range.

It is difficult to obtain sufficiently high receiver sensitivity over such a wide frequency range. Thus, the occurrence of a frequency range having low receiver sensitivity is inevitable. This is because the antenna length (loop length in the case of a loop antenna) determines the reception frequency range, and the receiver sensitivity of the antenna decreases in frequencies outside the frequency range.

To solve this problem, for example, sensitivity control means has been developed in which a magnetic element is movably disposed in a sensitivity control member to adjust the length of the magnetic element inserted into the sensitivity control member in accordance with the received frequency. However, this method requires a troublesome sensitivity control operation every time the received frequency is changed.

Terrestrial digital broadcasting is scheduled to start in the near future. Broadcast radio waves used for the terrestrial digital broadcasting are only in UHF band. Accordingly, the reception frequency band for digital broadcasting receivers is narrower than that for analog broadcasting receivers. However, a known earphone antenna is not suitable for the digital broadcasting receivers. This is because, as described above, the known earphone antenna does not implement effective countermeasures to eliminate the high-frequency affect on the receiver from a human body via the earphone and earphone antenna.

It is an object of the present invention to solve these problems and to provide an earphone antenna that can eliminate the high-frequency influence on a wireless device from a human body via an earphone, that can ensure the receiver sensitivity required for wide-frequency signals without performing a sensitivity control operation, and that can transmit audio signals from a television receiver to an earphone unit. It is another object of the present invention to provide a wireless device including the earphone antenna.

DISCLOSURE OF INVENTION

An earphone antenna according to the claim 1 includes a balun for changing a balanced mode to an unbalanced mode. One end of a pair of audio/high-frequency signal lines is connected to one terminal of the balun on the balanced side, and the other end of the pair of audio/high-frequency signal lines is connected to the other terminal of the balun on the balanced side. One portion of the pair of audio/high-frequency signal lines is connected to a left earphone unit, and another portion of the pair of audio/high-frequency signal lines is connected to a right earphone unit. In the earphone antenna, the pair of audio/high-frequency signal lines functions as a reception loop antenna for high-frequency signals and portions of the pair of audio/high-frequency signal lines from the balun to the left and the right earphone units function as audio signal transmission means for transmitting audio signals to the left and the right earphone units.

Consequently, according to the earphone antenna of the claim 1, the balun changes a balanced mode to an unbalanced mode and the two pairs of audio/high-frequency signal lines function as a reception loop antenna for high frequencies and function as the audio signal transmission means for audio signals. Therefore, a high-frequency reception antenna and an earphone can be integrated into one.

A wireless device according to the claim 4 is characterized in that the wireless device is composed of the balun according to the claim 1 and a reception unit connected to an unbalanced terminal of the balun of the earphone antenna via a cable.

Consequently, according to the wireless device of the claim 4, since the earphone antenna according to the claim 1 is used, the wireless device can provide the advantages of the earphone antenna.

A balun according to the claim 5 changes a balanced mode to an unbalanced mode. A pair of audio/high-frequency signal lines corresponding to the left earphone unit is connected to a terminal of the balun on the balanced side, and a pair of audio/high-frequency signal lines corresponding to a right earphone unit is connected to a terminal of the balun on the balanced side. Terminals of the two pairs of audio/high-frequency signal lines remote from the balun are connected to each other by two conductive lines via two loading coils respectively coupled with the terminals. The terminals are further connected to the left and light earphone units via the two loading coils, respectively. Each of the loading coils has high impedance for a specific frequency (for example, 200 MHz) higher that a predetermined fundamental frequency (for example, 100 MHz) so as to separate the two pairs of the pair of audio/high-frequency signal lines from each other for high frequencies and cause the signal lines to function as a dipole antenna, and has low impedance for the fundamental frequency (for example, 100 MHz) so as to connect the two pairs of the pair of audio/high-frequency signal lines to the loading coils and cause the both and the conductive lines to function as a loop antenna. Furthermore, each pair of audio/high-frequency signal lines functions as audio signal transmission means for audio signals going to the left and right earphone units.

Consequently, in an earphone antenna of the claim 5, the balun can change a high-frequency signal from a balanced mode to an unbalanced mode. In addition, the loading coil can have high impedance for a specific frequency (for example, 200 MHz) higher that a predetermined fundamental frequency (for example, 100 MHz) so as to separate the two pairs of the pair of audio/high-frequency signal lines from each other for high frequencies and cause the signal lines to function as a dipole antenna to resonate.

Additionally, the loading coil can have low impedance for the fundamental frequency (for example, 100 MHz) so that the two pairs of the pair of audio/high-frequency signal lines, the loading coils connected thereto, and the conductive lines connecting the loading coils can function as a loop antenna to resonate.

Therefore, the above-described components including the two pairs of audio/high-frequency signal lines form a loop antenna that resonates at a fundamental frequency (for example, 100 MHz) and further is excited with the higher harmonics of the fundamental frequency (a third harmonic: for example, 300 MHz, a fifth harmonic: for example, 500 MHz, and a seventh harmonic: for example, 700 MHz) and a dipole antenna that resonates with a signal of a specific frequency (for example, 200 MHz) higher than a predetermined frequency (for example, 100 MHz) and further is excited with a higher harmonic (a third harmonic: for example, 600 MHz). Thus, the earphone antenna can provide a receiver sensitivity characteristic having relatively less variation over a wide frequency range. Furthermore, in order to provide the receiver sensitivity characteristic, no sensitivity control operation is required.

Additionally, since the loading coil reduces the antenna length that is required for the resonation at a fundamental frequency (for example, 100 MHz), the antenna can resonate with a signal of a long wavelength even when its antenna length is short. Therefore, the receiver sensitivity for a low-frequency signal can be increased without increasing the length of the antenna. This is another considerable advantage.

Accordingly, a receiver sensitivity characteristic that is relatively stable over a wide frequency range can be obtained. Therefore, no sensitivity control is required for the earphone antenna to receive the sensitivity characteristic.

Additionally, in the earphone antenna according to Claim 5, since each pair of audio/high-frequency signal lines and the above-described loading coil function as audio signal transmission means for the left and right earphone unit, the earphone and the antenna can be integrated.

Consequently, the antenna can be used to receive a high-frequency signal over a wide frequency range. The antenna can also be used for means for transmitting an audio signal to the earphone unit, and therefore, the highly sensitive and wide frequency range antenna and the earphone can be integrated.

A wireless device according to the claim 13 is characterized in that the wireless device includes the earphone antenna according to the Claim 5, 6, 7, 8, 9, 10, 11, or 12 and a receiver device connected to a terminal of the balun at the unbalanced mode side.

The wireless device according to the claim 13 can provide the advantages of the earphone antenna according to the claim 5, 6, 7, 8, 9, 10, 11, or 12.

BRIEF DESCRIPTION OF THE DRAWINGS

FIG. 1A illustrates a schematic diagram and FIG. 1B illustrates a diagram of the equivalent circuit of the antenna.

FIG. 2A illustrates a pin jack connector; FIG. 2B illustrates the structure of a coaxial cable; and FIG. 2C illustrates the structure of a composite coil.

FIG. 5A illustrates the structure and FIG. 5B illustrates a circuit diagram.

FIG. 6A illustrates the structure and FIG. 6B illustrates a circuit diagram.

BEST MODE FOR CARRYING OUT THE INVENTION

Figure 1B:
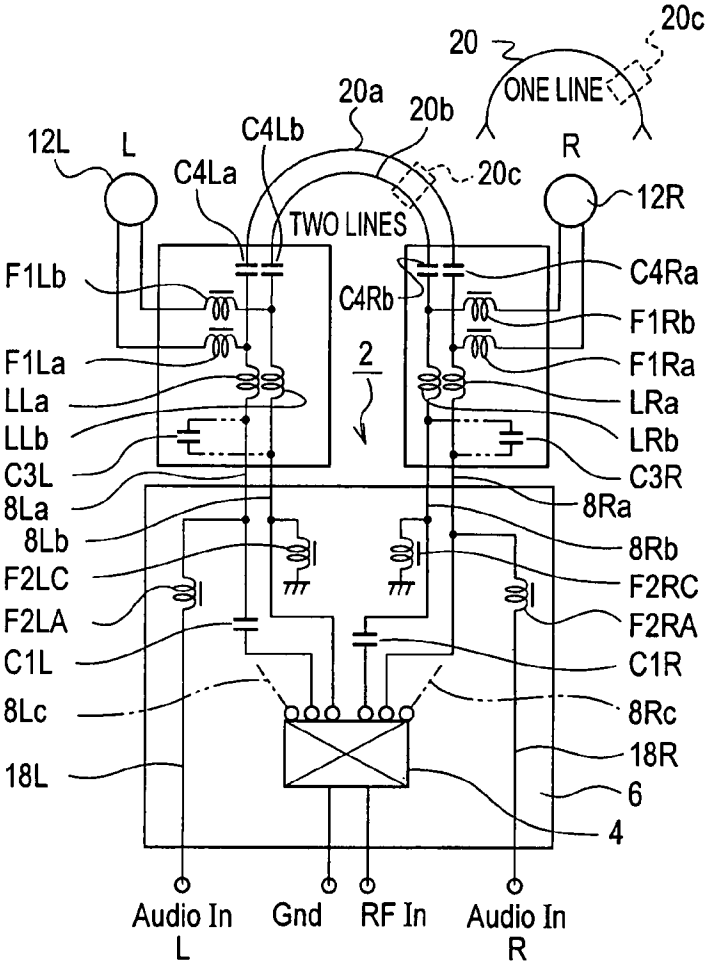
FIGS. 1A to 1B illustrate a first embodiment of an earphone antenna according to the present invention, where

In an earphone antenna according to the present invention, basically, one end of a pair of audio/high-frequency signal lines is connected to one terminal of a balun at a balanced mode side, and the other end of the pair of audio/high-frequency signal lines is connected to the other terminal of the balun at a balanced mode side. A part of the pair of audio/high-frequency signal lines is connected to a left earphone unit, and another part of the pair of audio/high-frequency signal lines is connected to a right earphone unit. For a high-frequency signal, the pair of audio/high-frequency signal lines functions as a reception loop antenna. For an audio signal, portions of the pair of audio/high-frequency signal lines starting from the balun to connection points with the left and right earphone units function as audio signal transmission means for the left and right earphone units.

When, for example, the earphone antenna is used for a terrestrial digital broadcasting receiver, it is desirable that the loop length of the pair of audio/high-frequency signal lines is about 65 cm. This is because this length provides a loop antenna for receiving high-frequency signals in all UHF frequency bands of terrestrial digital broadcasting while transmitting audio signals without any problem. Additionally, since the pair of audio/high-frequency signal lines is formed in a loop shape, the balun can be configured to be easily hung on the neck. However, some users may feel uncomfortable when their necks are passing through the loop having a length of about 65 cm. Accordingly, a releasable connector may be provided to the pair of audio/high-frequency signal lines so that the user may release the connector when he or she hangs or takes off the earphone antenna on his or her neck and may hook the connector to return the shape to a loop after he or she hangs the earphone antenna or takes off the earphone antenna.

It is also desirable that high-frequency blocking means (e.g., an inductance element (coil)) that has high impedance for a high-frequency signal to block the high-frequency signal (e.g., UHF waves) and that has low impedance for an audio signal to pass through the audio signal is disposed between the pair of audio/high-frequency signal lines and the right and left earphone units. This is because this configuration can eliminate the influence of the human body on a wireless device via the earphone, thus increasing the stability of the reception.

It is also desirable that audio blocking means (e.g., a capacitor) is disposed on the pair of audio/high-frequency signal lines at a position more distant than a connection point between the left and right earphone units from the terminal of the balun on the balanced side. This is because this configuration prevents audio signals transmitted to the left and right earphone units from leaking into a conductive line, thus reducing the drop in audio signal level of the earphone.

When the earphone antenna is used for a regular terrestrial broadcasting receiver (an analog terrestrial broadcasting receiver), a loading coil is added to each of two pairs of audio signal/high-frequency signal lines, one pair of which is connected to the balun and the left earphone unit and the other pair of which is connected to the balun and the right earphone unit. In addition, a conductive line is provided to connect the right loading coil to the left loading coil.

In this case, since the loading coil has high impedance or low impedance depending on the frequency band, the two pairs of audio/high-frequency signal lines function as a dipole antenna, which resonates with a high-frequency signal for the above-described specific frequency (200 MHz), and also function as a loop antenna, which resonates at the above-described fundamental frequency (100 MHz), in corporation with the pair of loading coils and the conductive line.

Additionally, when the earphone antenna is used for a regular terrestrial broadcasting receiver, only one audio/high-frequency signal line in each pair of audio/high-frequency signal lines connected to the left or right earphone unit may be connected to a terminal of the balun on the balanced side and the other audio/high-frequency signal lines in each pair of audio/high-frequency signal lines are connected to each other for high frequencies so that a single-loop antenna is formed which includes one audio/high-frequency signal line in the pair of audio/high-frequency signal lines corresponding to the left earphone unit, the other audio/high-frequency signal line in the pair, one audio/high-frequency signal line in the pair of audio/high-frequency signal lines corresponding to the right earphone unit, the other audio/high-frequency signal line in the pair, and the conductive line. In this case, the effective total length of the loop antenna is doubled, and therefore, the lower reception frequency range can be received.

Additionally, it is desirable that an adverse effect on the high-frequency reception caused by the human body is prevented by providing high frequency blocking means (e.g., ferrite bead or choke coil) between the pair of audio/high-frequency signal lines and the earphone unit. This is because this configuration can increase the stability of the reception.

Additionally, a frequency-range expanding capacitor may be provided between audio/high-frequency signal lines in the left pair and the light pair. This is because this configuration can expand the reception frequency range.

Additionally, a high-frequency blocking means (e.g., ferrite bead (choke coil)), which has high impedance for a high-frequency signal, may be provided in an audio signal transmission path for transmitting an audio signal to each pair of audio/high-frequency signal lines of the earphone antenna in order to prevent unwanted frequency signals from entering the audio signal transmission path.

Two left and right pairs of loading coils may be composed of an independent element. However, this configuration may increase the space for the loading coil, and the space for a loading coil including the loading coil, and therefore, the size and weight of the earphone antenna may increase. Accordingly, to prevent the size of the earphone antenna from increasing, the loading coil for each pair may be composed of a composite coil in which a plurality of coils each of which includes two windings sharing one core are integrated.

Additionally, since the earphone antenna according to the present invention transmits a high-frequency signal to a reception unit of a wireless device distant from the earphone antenna and receives an audio signal from the reception unit, the earphone antenna preferably employs a coaxial cable for transmitting and receiving the high-frequency and audio signals to and from the reception unit in order to prevent noise and increase the stability of the reception. The coaxial cable preferably includes a central conductor for allowing a high-frequency signal to pass through, an insulating material surrounding the central conductor, a shielded wire surrounding the insulating material, an insulating material surrounding the shielded wire, and left and right audio signal lines outside the insulating material.

This configuration allows one coaxial cable to transmit a high-frequency signal and the left and right audio signals. Thus, the coaxial cable is suitable as a coaxial cable for connecting the earphone antenna to the reception unit of the wireless device. Two audio signal lines and the shielded wire transmit the left and right sounds. In addition, a common audio signal line may be wound around the second insulating material, and the two audio signal lines and the common audio signal line may transmit the left and right audio signals.

Each of the signal lines is preferably formed by twisting a plurality of wires so that the signal line has conductivity and mechanical flexibility. For example, an annealed copper wire or a litz wire is suitable for the material of the signal line.

One of the two pairs of audio/high-frequency signal lines may be at an angle of substantially 180° with respect to the other of the two pairs of audio/high-frequency signal lines at the side adjacent to the balun. This configuration allows the two pairs of audio/high-frequency signal lines to function as a U dipole antenna for a signal of the above-described specific frequency (for example, 200 MHz).

The angle may be smaller than about 180°. This structure allows the two pairs of audio/high-frequency signal lines to function as a V dipole antenna for a signal of the above-described specific frequency (for example, 200 MHz).

As described above, the present invention provides a variety of embodiments.

Embodiments of the present invention are described in detail below with reference to the accompanying drawings.

Figure 1A:
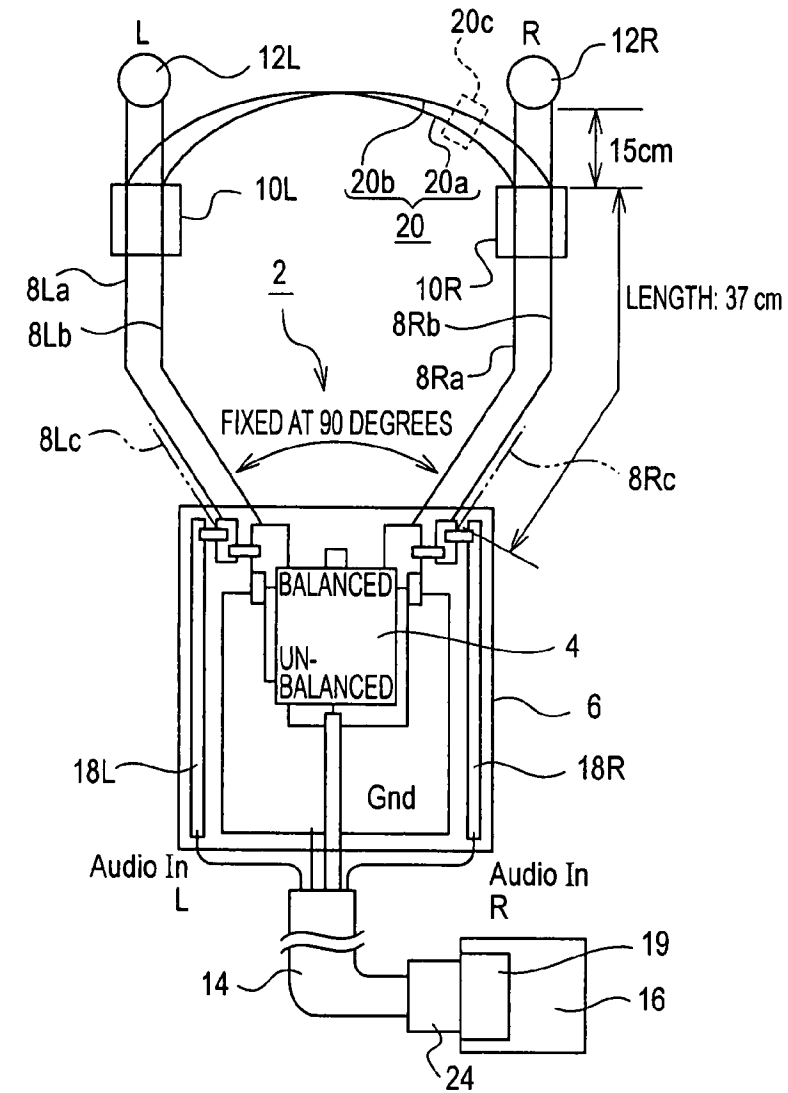
Figure 2A:
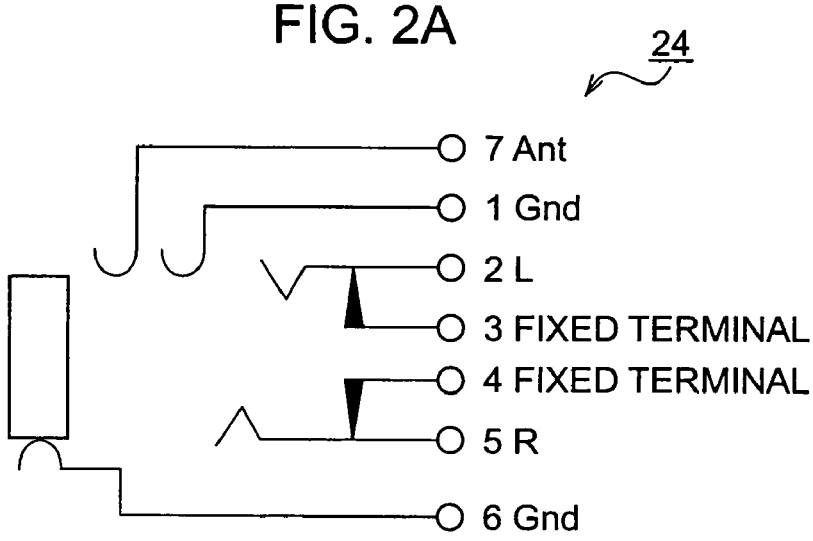
FIGS. 2A to 2C illustrate components used for the earphone antenna, where
Figure 2B:
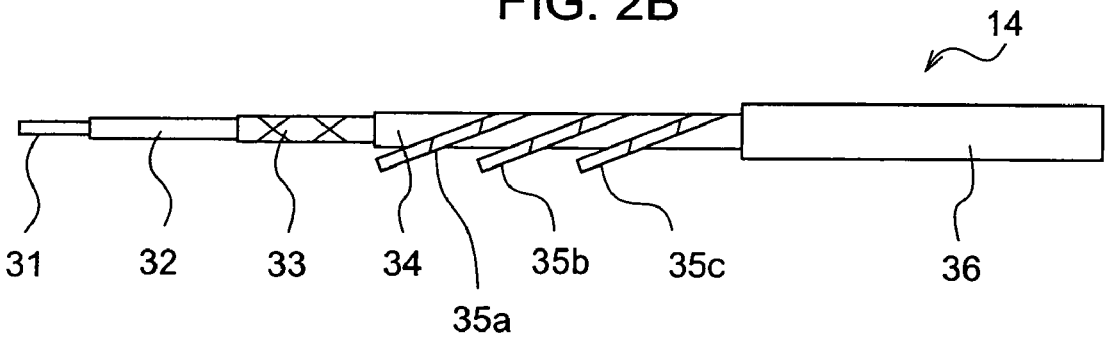
Figure 2C:
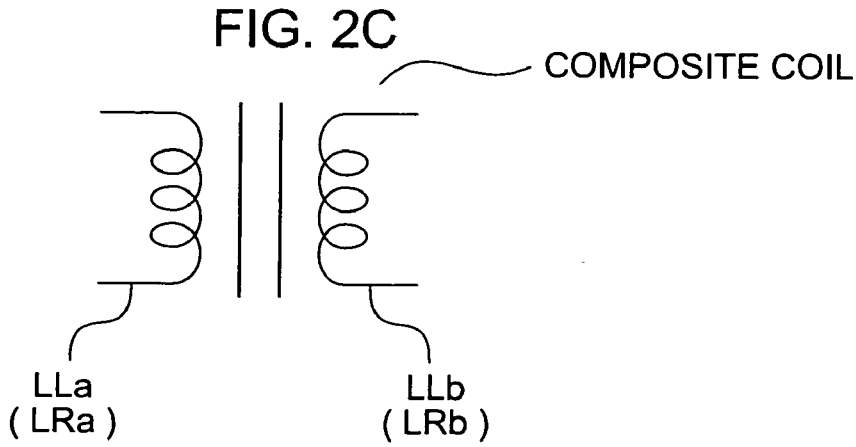

FIGS. 1A to 1B illustrate a first embodiment 2 of an earphone antenna according to the present invention. FIG. 1A is a structural diagram illustrating the principle of the earphone antenna. FIG. 1B is a diagram of the equivalent circuit of the antenna. FIGS. 2A to 2C illustrate components used for the earphone antenna. FIG. 2A is a diagram of a pin jack connector. FIG. 2B is a diagram of the structure of a coaxial cable. FIG. 2C is a diagram of the structure of a composite coil.

As shown in the drawings, an earphone antenna 2 (the first embodiment 2 of a earphone antenna according to the present invention) includes a matching box 6 containing a balun 4, audio/high-frequency signal lines 8La, 8Lb, 8Ra, and 8Rb connected to terminals of the balun 4 on the balanced side, a pair consisting of loading boxes 10L and 10R connected to terminals of the audio/high-frequency signal lines 8La, 8Lb, 8Ra, and 8Rb remote from the balun, and a pair consisting of conductive lines 20*a* and 20*b* for connecting the loading box 10L to the loading box 10R.

Earphone units 12R and 12L and conductive lines 20*a* and 20*b* are connected to terminals of the loading boxes 10L and 10R remote from the audio/high-frequency signal lines 8La, 8Lb, 8Ra, and 8Rb. The audio/high-frequency signal lines 8La, 8Lb, 8Ra, and 8Rb and the conductive lines 20*a* and 20*b* are formed by twisting a plurality of conductive and mechanically flexible wires (for example, annealed copper wires). The strand wires may be litz wires each of which is insulated. The length of the pair of conductive lines 20*a* and 20*b* is about 40 cm.

The balun 4 converts a balanced mode to an unbalanced mode while providing impedance conversion. In this embodiment, the balun 4 provides impedance transformation from 200Ω balanced to 75Ω unbalanced. The left audio/high-frequency signal lines 8La and 8Lb extend from one terminal of the balun 4 on the balanced side, whereas the right audio/high-frequency signal lines 8Ra and 8Rb extend from the other terminal of the balun 4 on the balanced side. The left audio/high-frequency signal lines 8La and 8Lb are at a fixed angle of more than or equal to 30° (90° in this example) with respect to the right audio/high-frequency signal lines 8Ra and 8Rb within the first 5 cm from the terminal of the balun 4 on the balanced side so as to function as a V dipole antenna. These parts functioning as the V dipole antenna have relatively strong rigidness to maintain a V shape. The length from the balun 4 to the impedance box 10L or 10R (i.e., antenna length at one side) is, for example, 37 cm or more.

The reason why one side of the antenna is composed of two signal lines (i.e., 8La and 8Lb for the left side and 8Ra and 8Rb for the right side) is to cause these earphone cords, namely, the audio/high-frequency signal lines 8La, 8Lb, 8Ra, and 8Rb to function not only as a reception antenna for a high-frequency signal but also as audio signal transmission means for transmitting an audio signal to the left and right earphone units 12L and 12R. Additionally, to expand the frequency band of the reception antenna (loop antenna) to the lower frequency side, capacitors C3L and C3R may be connected between the audio/high-frequency signal lines 8La and 8Lb and between the audio/high-frequency signal lines 8Ra and 8Rb, respectively.

As shown by a chain double-dashed line in FIGS. 1A through 1B, auxiliary antennas 8Lc and 8Rc may be provided in order to compensate for the characteristic. The auxiliary antennas 8Lc and 8Rc are preferably, for example, 50 mm in length and are located at positions distant from the audio/high-frequency signal lines 8La, 8Lb, 8Ra, and 8Rb by at least 5 mm.

Signal lines 8La, 8Lb, 8Ra, and 8Rb (and 8Lc and 8Rc) having sizes and shapes shown in FIG. 1A resonate with a high-frequency signal of 200 MHz to function as a V dipole antenna that is excited by the higher harmonics of the high-frequency signal (third harmonic, fifth harmonic, and seventh harmonic).

A terminal of the balun 4 at the unbalanced mode side is connected to a receiver, for example, a liquid crystal display TV (television receiver) 16 via a coaxial cable 14.

The coaxial cable 14 is connected to the liquid crystal display TV 16 using a pin jack connector 24 having the pin arrangement shown in FIG. 2A.

As shown in FIG. 2B, the coaxial cable 14 is a coaxial integrated cable in which a high-frequency signal line and an audio signal line are integrated. The single coaxial cable transmits a high-frequency signal and left and right audio signals. The high-frequency signal line and an audio signal line are not necessarily transmitted in a single coaxial cable. Instead, the two lines may be transmitted by different cables. However, the transmission of high-frequency signal and audio signal by a single coaxial cable advantageously reduces the number of cables required, which in turn reduces the size, weight, and cost of the earphone antenna.

The coaxial cable 14 connects the earphone antenna 2 to a wireless device, for example, a reception circuit (reception unit) 19 mounted in a body of the liquid crystal display TV (television receiver) 16. The coaxial cable 14 has the structure shown in FIG. 2A.

That is, the coaxial cable 14 includes a central conductor 31, which allows a high-frequency signal to pass through, as a center core. The central conductor 31 is covered by an insulating material 32, which is then covered by a shielded wire 33 (e.g., bare annealed copper wire). The shielded wire 33 is covered by, for example, winding a tape 34. The tape 34 is wound by three audio signal lines 35*a*, 35*b*, and 35*c* which are insulated to each other. Finally, the three audio signal lines 35*a*, 35*b*, and 35*c* are covered by an insulating jacket 36. One of the three audio signal lines 35*a*, 35*b*, and 35*c* serves as a left audio signal line. One of the other two serves as a right audio signal line. The last one serves as a common audio signal line (grand line). However, in this embodiment, the common audio signal line is an idle line. Audio signals are transmitted by the left and right audio signal lines and the shielded wire.

The above-described left loading box 10L is connected between the audio/high-frequency signal lines 8La and 8Lb and the left earphone unit 12L and between the audio/high-frequency signal lines 8La and 8Lb and the conductive lines 20*a*. The above-described right loading box 10R is connected between the audio/high-frequency signal lines 8Ra and 8Rb and the right earphone unit 12R and between the audio/high-frequency signal lines 8Ra and 8Rb and the conductive line 20*b*.

The loading box 10L includes loading coils LLa and LLb arranged as shown in FIG. 2C, ferrite beads F1La and F1Lb whose one ends are respectively connected to the loading coils LLa and LLb, and capacitors C4La and C4Lb whose one ends are respectively connected to the loading coils LLa and LLb. The capacitors C4La and C4Lb function as audio signal blocking means.

The other ends of the ferrite beads F1La and F1Lb are connected to the left earphone unit 12L.

The loading box 10R includes loading coils LRa and LRb, ferrite beads F1Ra and F1Rb whose one ends are respectively connected to the loading coils LRa and LRb, and capacitors C4Ra and C4Rb whose one ends are respectively connected to the loading coils LRa and LRb. The capacitors C4Ra and C4Rb function as audio signal blocking means.

The other ends of the ferrite beads F1Ra and F1Rb are connected to the left earphone unit 12R.

The ferrite beads F1La, F1Lb, F1Ra, and F1Rb (for example, "BLM18HD102SN1 size 1608" which is available from Murata Manufacturing Co., Ltd.) have low impedance for audio signals in the frequency range lower than or equal to 20 kHz so as to allow the audio signals to be transmitted between the loading coils LLa, LLb, LRa, and LRb and the earphone units 12L and 12R. The ferrite beads F1La, F1Lb, F1Ra, and F1Rb have high impedance (for example, 1 kHz) for high-frequency signals so as to block (cut) the signals between the loading coils LLa, LLb, LRa, and LRb and the earphone units 12L and 12R. Accordingly, high-frequency signals are prevented from entering the reception circuit 19 from the human body via the earphone units 12L and 12R and the audio/high-frequency signal lines 8La, 8Lb, 8Ra, and 8Rb. Thus, stable reception can be obtained.

Additionally, the other ends of the capacitors C4La and C4Lb are connected to the other ends of the capacitors C4Ra and C4Rb via the conductive lines 20*a* and 20*b*. The capacitors C4La, C4Lb, C4Ra, and C4Rb block audio signals so that the audio signals transmitted to the earphone units are prevented from leaking into the conductive lines 20*a* and 20*b*. However, the capacitors C4La, C4Lb, C4Ra, and C4Rb allow high-frequency signals to pass therethrough. The capacitance of the capacitors is, for example, 10 pF.

Figure 3:
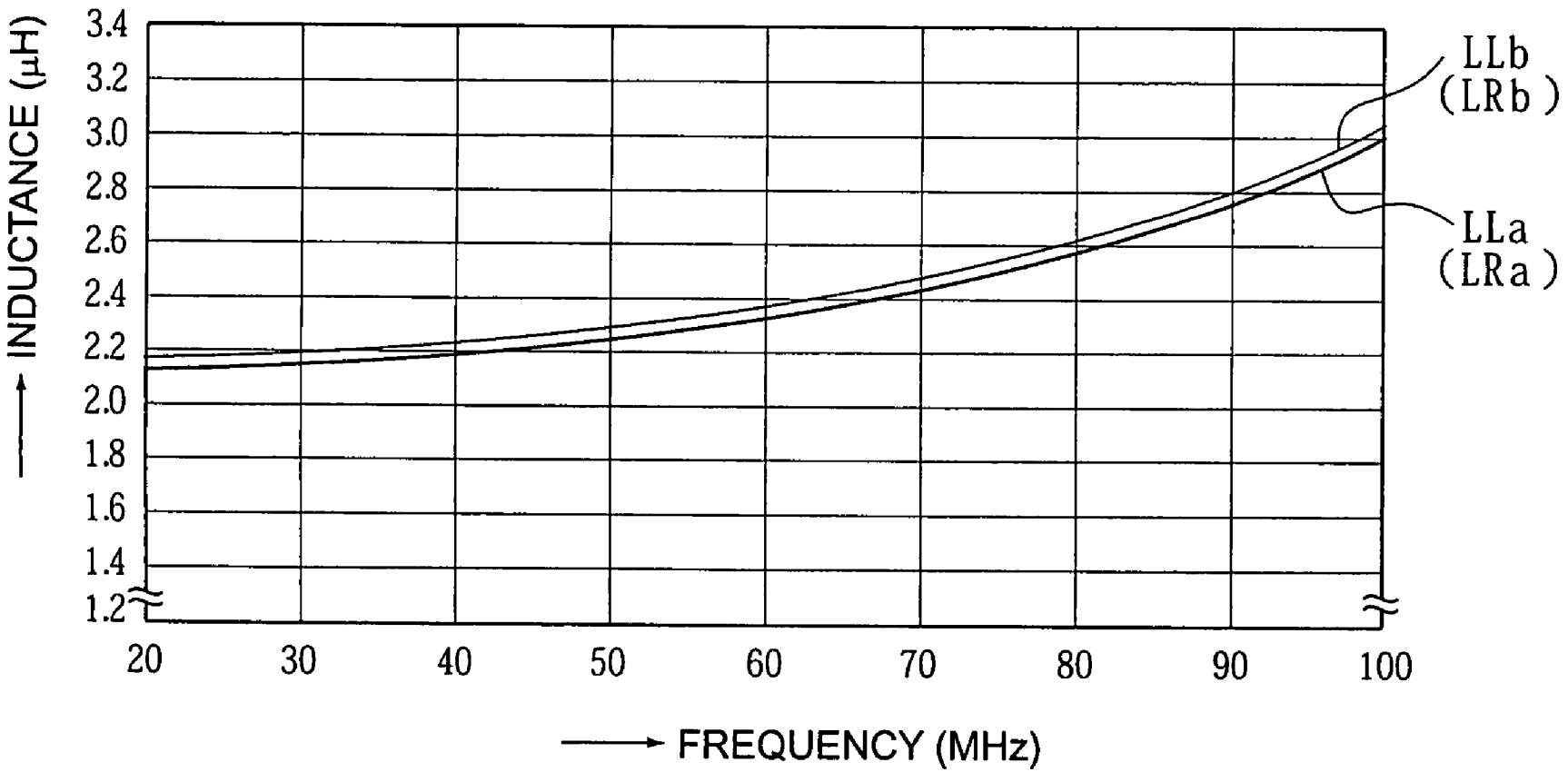
FIG. 3 is a curve sheet illustrating a relationship between frequency and inductance of a loading coil used in the embodiment.
Figure 4:
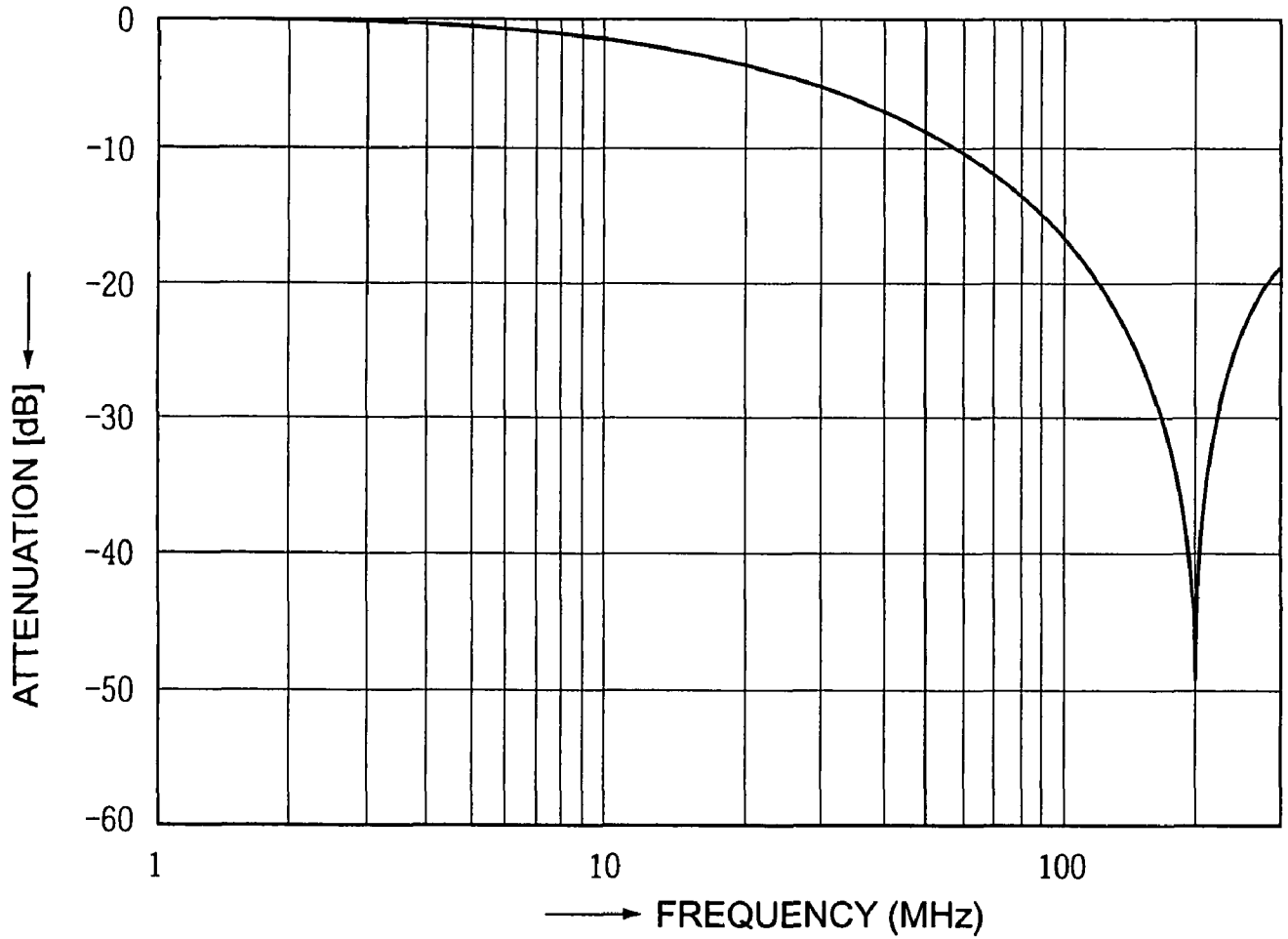
FIG. 4 is a curve sheet illustrating a relationship between frequency and insertion loss of the loading coil used in the embodiment.

The loading coils LLa, LLb, LRa, and LRb have a frequency-dependent inductance-characteristic, for example, as shown in FIG. 3, in which the inductance is about 3.0 μH at a frequency of 100 MHz. Additionally, as shown in FIG. 4, the insertion loss becomes maximum at a frequency of 200 MHz. More specifically, the insertion loss becomes as high as 50 dB (a gain=−50 dB) at a frequency of 200 MHz. That is, the loading coils LLa, LLb, LRa, and LRb are of such a high impedance that electrical separation is virtually caused. By comparison, the insertion loss is only about 15 dB (a gain=−15 dB) at a frequency of 100 MHz. This is a low impedance that does not cause electrical separation.

Audio signal transmission lines 18L and 18R are connected to the audio/high-frequency signal lines 8La and 8Ra via ferrite beads F2LA and F2RA (for example, "BLM18HD102SN1 size 1608" available from Murata Manufacturing Co., Ltd.), which are high-frequency blocking means. The audio/high-frequency signal lines 8Lb and 8Rb are connected to ground via ferrite beads F2LC and F2RC having the same characteristic as the ferrite beads F2LA and F2RA.

The ferrite beads F2LA, F2RA, F2LC, and F2RC prevent a high-frequency signal from leaking into an audio signal path. These beads have high impedance (for example, higher than or equal to 1 kΩ) in the frequency range of a television broadcast signal so as to block (cut) a high-frequency signal, whereas these ferrite beads have low impedance in the frequency range (lower than or equal to 20 kHz) of an audio signal so as to allow the audio signal to pass therethrough.

Separation capacitors C1L and C1R are disposed between the audio/high-frequency signal lines 8La and 8Ra and the balanced terminals of the balun 4 to separate an audio signal line from the common audio signal line (ground line). The left and right audio signals are separated from the common signal line (ground line), thereby enabling coils of the earphones to operate. The capacitance of the separation capacitors C1L and C1R is, for example, 10 pF.

Frequency range expansion capacitors C3L and C3R are disposed between the audio/high-frequency signal lines 8La and 8Lb and between the audio/high-frequency signal lines 8Ra and 8Rb, respectively. The frequency range expansion capacitors C3L and C3R expand the reception frequency range towards a low-frequency side.

In the earphone antenna 2, a 100-MHz resonant loop antenna, a 200-MHz resonant V dipole antenna, and an audio signal line coexist. That is, the earphone antenna 2 has a function of a 100-MHz resonant loop antenna, a 200-MHz resonant V-shaped dipole antenna, and a function to transmit left and right audio signals to the left and right earphone units 12L and 12R.

The function of the 100-MHz resonant loop antenna is described first. As shown in FIG. 4, each of the loading coils LLa, LLb, LRa, and LRb has an insertion loss of as low as about 15 dB (gain=−15 dB) for a signal of a frequency of 100 MHz. Therefore, the loading coils LLa, LLb, LRa, and LRb cannot be separated from the audio/high-frequency signal lines 8La, 8Lb, 8Ra, and 8Rb for high frequencies.

Accordingly, for a signal of a frequency of 100 MHz, a loop antenna consisting of the audio/high-frequency signal lines 8La, 8Lb, 8Ra, and 8Rb, the loading coils LLa, LLb, LRa, and LRb, and the conductive lines 20*a* and 20*b* functions as a reception antenna to resonate with the signal.

Additionally, the loading coils LLa, LLb, LRa, and LRb have a resonant antenna-length reducing function to reduce the antenna length required for resonating at a fundamental frequency (for example, 100 MHz). Thus, the loading coils LLa, LLb, LRa, and LRb can increase receiver sensitivity for a low-frequency signal even though the antenna length is short.

That is, a dipole antenna requires an antenna length of ½ of a wavelength λ, and a loop antenna requires an antenna length of about 1 to 1.5 times a wavelength λ. Accordingly, in the case of a loop antenna, to resonate at 100 MHz, an antenna loop length of 3.0 m is required. This is impractical for a portable wireless device (a liquid crystal display TV).

However, the earphone antenna 2 has the loading coils LLa, LLb, LRa, and LRb. The resonant antenna-length reducing function of the loading coils LLa, LLb, LRa, and LRb allows the earphone antenna 2 of a short antenna length to receive a low-frequency signal with sufficient receiver sensitivity.

More specifically, the loading coils LLa and LLb having an inductance of about 3.0 μH at a frequency of 100 MHz allow the earphone antenna 2 of a practical antenna length for a neck strap to resonate with a 100-MHz frequency signal, which is a relatively low frequency (long wavelength) signal in the television broadcast frequency range.

Accordingly, a 100-MHz resonant loop antenna having a practical antenna length can be formed from the audio/high-frequency signal lines 8La, 8Lb, 8Ra, and 8Rb, the loading coils LLa, LLb, LRa, and LRb, and the conductive lines 20*a* and 20*b*. This antenna having a practical antenna length resonates at a frequency of 100 MHz, and is further excited with the harmonics of 100 MHz (a third harmonic, a fifth harmonic and a seventh harmonic).

The length of the loop antenna is determined to be 1.13λ including the length of the conductive lines 20*a* and 20*b* (40 cm), which are located at the back of the neck.

The function of the 200-MHz resonant dipole antenna is described next. As shown in FIG. 4, each of the loading coils LLa, LLb, LRa, and LRb has an insertion loss of as high as 50 dB (gain=−50 dB) for a signal of a frequency of 200 MHz. Therefore, the loading coils LLa, LLb, LRa, and LRb are virtually separated from the audio/high-frequency signal lines 8La, 8Lb, 8Ra, and 8Rb. Only the audio/high-frequency signal lines 8La, 8Lb, 8Ra, and 8Rb function as an antenna, and more specifically, as a dipole antenna.

Since the dipole antenna consisting of only the audio/high-frequency signal lines 8La, 8Lb, 8Ra, and 8Rb has an antenna length of 37 cm at one side, the dipole antenna resonates with a 200-MHz frequency signal. Accordingly, a V dipole antenna is provided that resonates with a 200-MHz frequency signal and is excited by the harmonics of the 200 MHz frequency signal (third harmonic, fifth harmonic, and seventh harmonic).

It should be noted that a dipole antenna has a tendency to have an actual resonant wavelength slightly shorter than the computed wavelength for each antenna length.

The function of transmitting an audio signal is described next.

The left and right audio signals are transmitted from the reception circuit 19 mounted in the body of the liquid crystal display TV 16 to the audio/high-frequency signal lines 8La, 8Lb, 8Ra, and 8Rb via the coaxial cable 14, the left and right audio signal transmission lines 18L and 18R, and an earth line. The left and right audio signals are then transmitted to the earphone units 12L and 12R via the loading boxes 10L and 10R. The left and right audio signals are played back by the earphone units 12L and 12R as sound.

Since the antenna has a function to transmit the audio signals, the antenna and the earphone unit can be integrated into the earphone antenna 2.

As described above, the earphone antenna 2 functions as a 100-MHz resonant loop antenna and a 200-MHz resonant dipole antenna without any receiver sensitivity control operation. Consequently, the earphone antenna 2 resonates at frequencies of 100 MHz and 200 MHz, thereby providing high receiver sensitivity over a wide frequency range sufficiently covering the television broadcast frequency range while being excited by the higher harmonics of the 100-MHz and 200-MHz signals (third harmonic, fifth harmonic, and seventh harmonic). Furthermore, the earphone antenna 2 can transmit the left and right audio signals from the reception circuit 19 in the liquid crystal display TV 16 to the earphone units 12L and 12R.

Still furthermore, the ferrite beads F1La, F1Lb, F1Ra, and F1Rb can eliminate high-frequency influence of the human body on the earphone antenna 2 via the earphone units 12L and 12R. As a result, the stability of reception of the liquid crystal display TV 16 is not affected by the human body.

In this earphone antenna, the left and right audio/high-frequency signal lines 8La, 8Lb, 8Ra, and 8Rb are all equal in length (37 cm in this example). Additionally, in this example, the left audio/high-frequency signal lines 8La and 8Lb are fixed at an angle of more than or equal to 90° with respect to the right audio/high-frequency signal lines 8Ra and 8Rb within the first 5 cm from the balun 4. However, as the angle decreases and as the length of the fixed portion decreases, the receiver sensitivity decreases.

Additionally, in this example, the two conductive lines 20*a* and 20*b* are used. However, the number of conductive lines may be one, as shown by the right upper shoulder section of FIG. 1B. This is because audio signals input to the audio/high-frequency signal lines 8La, 8Lb, 8Ra, and 8Rb are blocked by the audio signal blocking capacitors C4La, C4Lb, C4Ra, and C4Rb, and therefore, the audio signals cannot enter a conductive line 20. Electrically, the conductive line 20 only functions as a part of the loop antenna for a high-frequency signal. Thus, one conductive line is sufficient. In other words, the conductive line does not transmit audio signals to the left and right earphones, and therefore, another conductive line is not necessary.

A user who has a large head size may have a difficulty to hang the neck strap of the balun 4 or cannot hang the neck strap of the balun 4. Accordingly, as described above, a connector 20*c* may be provided as a part of the conductive lines 20*a* and 20*b* (or the conductive line 20) so that the neck strap is releasable.

Figure 5B:
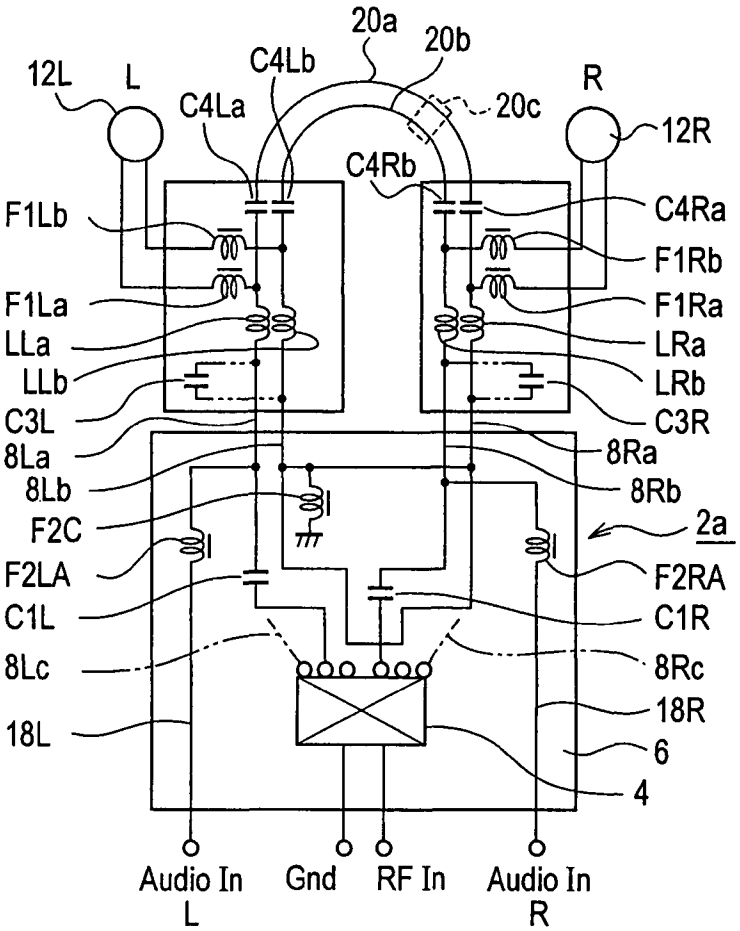
FIGS. 5A to 5B illustrate a second embodiment of an earphone antenna according to the present invention, where
Figure 5A:
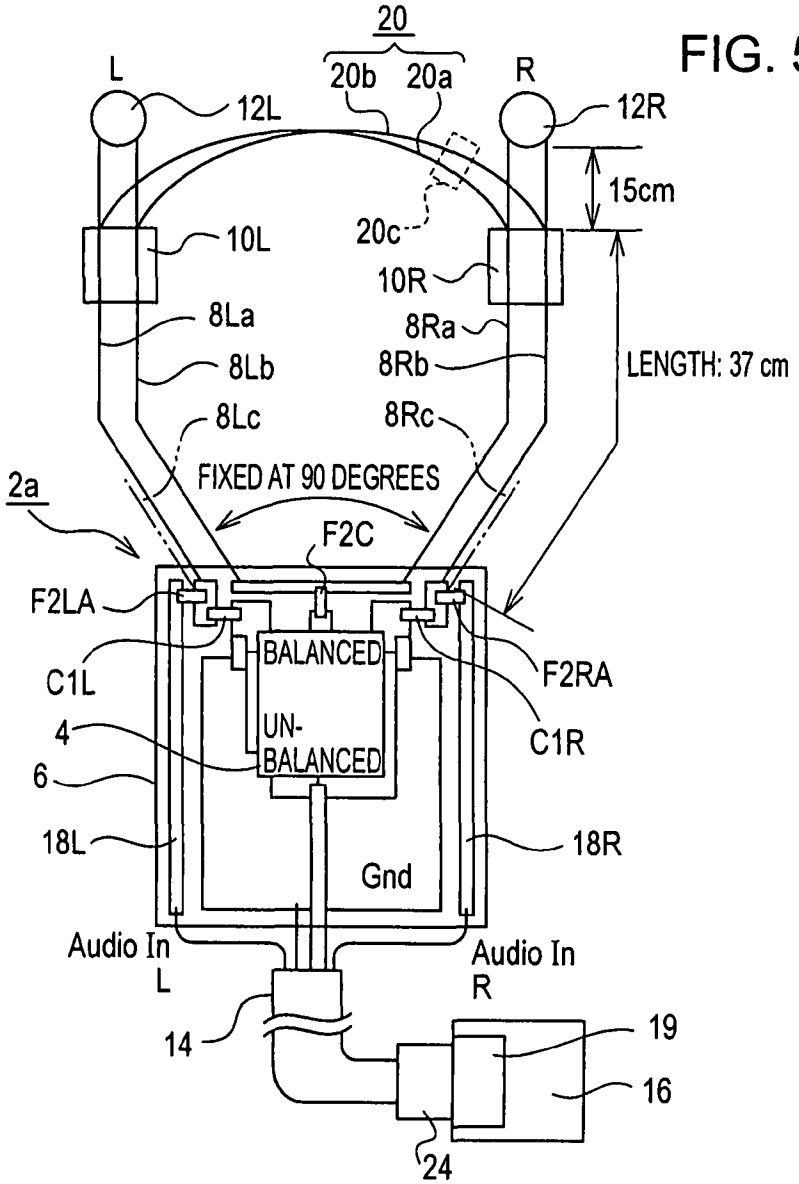

FIGS. 5A and 5B illustrate a second embodiment 2*a* of an earphone antenna according to the present invention. FIG. 5A is a diagram illustrating the structure. FIG. 5B is a circuit diagram of the antenna.

In the second embodiment 2*a*, the audio/high-frequency signal line 8Lb is connected to the audio/high-frequency signal line 8Ra without being connected to the balun 4, thereby forming a single-loop antenna structure. A ferrite bead FBC is connected between the audio/high-frequency signal lines 8Lb and 8Ra connected to each other and ground. This embodiment 2*a* differs from the first embodiment 2 in the above-described two structures. The other structures of the embodiment 2*a* are identical to those of the first embodiment 2.

According to this embodiment 2*a*, the embodiment 2*a* has a single-loop antenna structure. Accordingly, although the baluns have the same size, the effective length of the entire loop antenna is doubled. The balun having the same size can receive a high-frequency signal in the low frequency band. For example, a signal in 50-MHz frequency band, which is used in, for example, the USA, can be received.

Figure 6B:
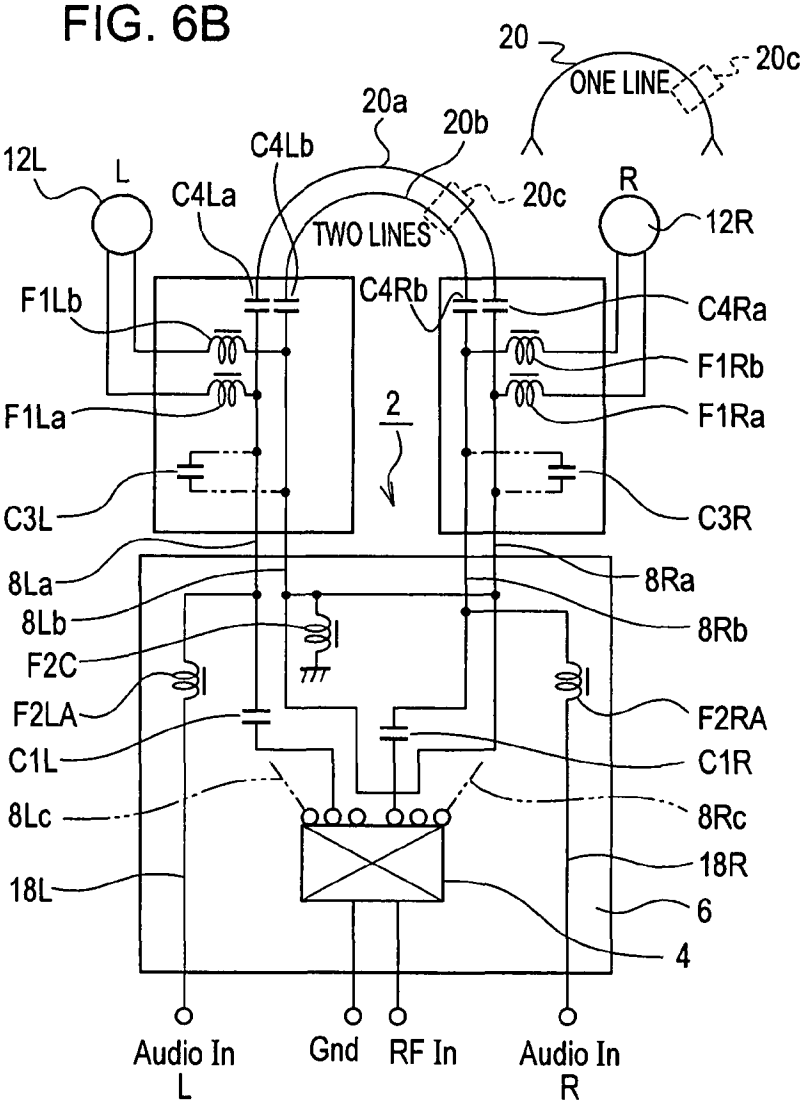
FIGS. 6A to 6B illustrate a second embodiment of an earphone antenna according to the present invention, where
Figure 6A:
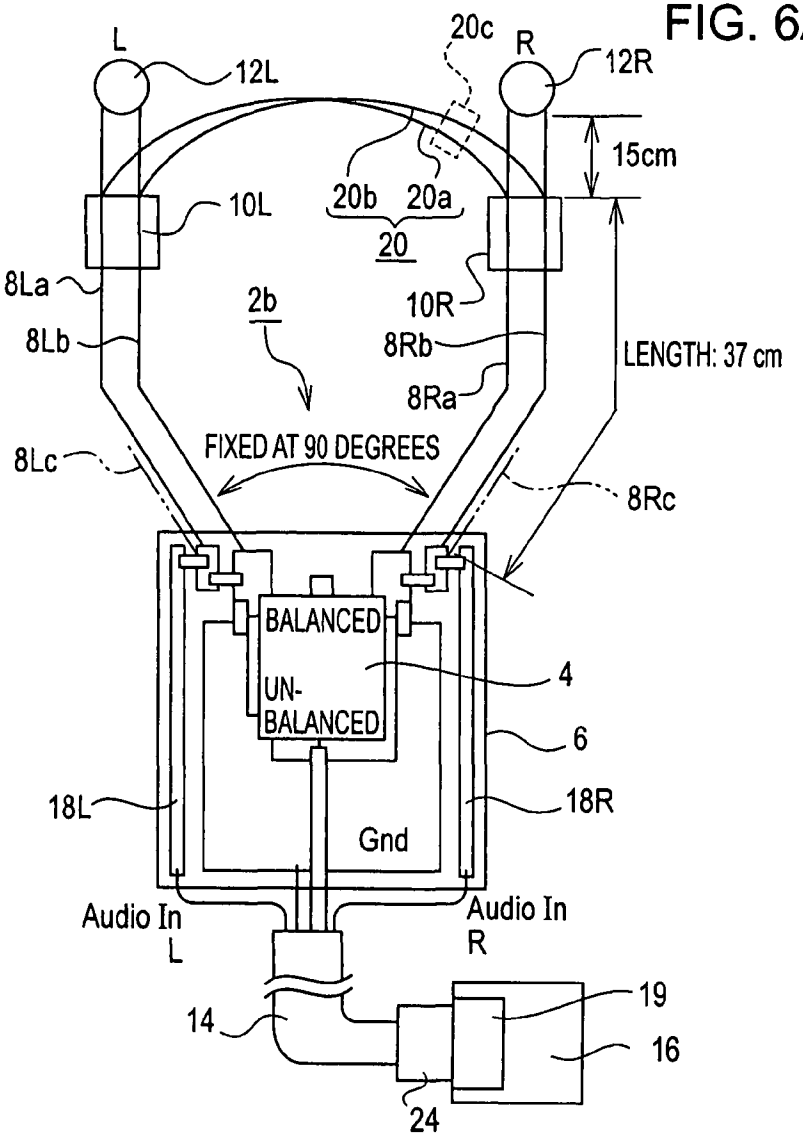

FIGS. 6A and 6B illustrate a third embodiment 2*b* of an earphone antenna according to the present invention. FIG. 6A is a diagram illustrating the structure. FIG. 6B is a circuit diagram of the antenna.

In the third embodiment 2*b*, the present invention is applied to an antenna for receiving terrestrial digital broadcasting. Only radio-frequency waves in the UHF band (470 to 770 MHz) can be received.

Accordingly, unlike the first embodiment 2 and the second embodiment 2*a*, a loading coil can be eliminated. Additionally, the length of the audio/high-frequency signal lines 8La, 8Lb, 8Ra, and 8Rb can be reduced.

In this embodiment 2*b*, as described above, since a loading coil can be eliminated, one ends of ferrite beads F1La, F1Lb, F1Ra, and F1Rb are connected to terminals of the audio/high-frequency signal lines 8La, 8Lb, 8Ra, and 8Rb remote from the balun. The other ends of the ferrite beads F1La, F1Lb, F1Ra, and F1Rb are connected to the earphone units 12L and 12R.

Additionally, one ends of the audio signal blocking capacitors C4La, C4Lb, C4Ra, and C4Rb are connected to the terminals of the audio/high-frequency signal lines 8La, 8Lb, 8Ra, and 8Rb remote from the balun. The other end of C4La is connected to the other ends of C4Ra via the conductive line 20*a*. The other end of C4Lb is connected to the other ends of C4Rb via the conductive line 20*b*. Like the first embodiment 2, the two conductive lines 20*a* and 20*b* may be replaced with the single conductive line 20.

These ferrite beads F1La, F1Lb, F1Ra, and F1Rb, noise absorbing capacitors C2L and C2R, and the audio signal blocking capacitors C4La, C4Lb, C4Ra, and C4Rb are contained in ferrite bead capacitor boxes 40L and 40R.

The entire length of the loop antenna of the embodiment 2*b* is preferably 65 cm for the UHF band (470 to 770 MHz).

In the above-described embodiments 2, 2a, and 2b, the audio/high-frequency signal lines 8La and 8Lb are at an angle of, for example, 90° with respect to the audio/high-frequency signal lines 8Ra and 8Rb while extending from the balun 4. However, in the present invention, the angle may be about 180°.

In the above-described first embodiment 2, the connector 20*c* may be provided to the conductive lines 20*a* and 20*b* (or the conductive line 20). Similarly, in the second and third embodiments 2a and 2b, the connector 20*c* may be provided for a user to easily hang the antenna on the neck.

According to an earphone antenna of the claim 1, a balun converts a balanced mode to an unbalanced mode. In addition, since the above-described two pairs of audio/high-frequency signal lines function as a reception loop antenna for a high-frequency signal and function as audio signal transmission means for an audio signal, a high-frequency reception antenna and an earphone unit can be integrated into one.

According to an earphone antenna of the claim 2, high-frequency signal blocking means are provided between the earphone and the audio/high-frequency signal lines. The high-frequency signal blocking means has high impedance for a high-frequency signal so as to virtually block the signal, whereas the high-frequency signal blocking means has low impedance for an audio signal so as to allow the signal to pass therethrough. Consequently, the high-frequency signal blocking means can prevent high-frequency adverse effects on the antenna and a wireless device transmitted from the human body via the earphone.

According to a balun of the claim 3, audio signal blocking means can prevent an audio signal transmitted through a pair of audio/high-frequency signal lines from not going to the left and right earphone units due to leakage, thereby preventing audio signal levels in the left and right earphone units from decreasing.

According to a wireless device of the claim 4, since the earphone antenna according to the claim 1 is employed, the wireless device can also provide the advantages of the earphone antenna.

According to an earphone antenna of the claim 5, a high-frequency signal can be converted from a balanced mode to an unbalanced mode by a balun. Additionally, a loading coil has high impedance for a signal having a specific frequency (for example, 200 MHz) higher than a fundamental frequency (for example, 100 MHz) so as to separate the high frequency signal from the two pairs of audio/high-frequency signal lines. Accordingly, the two pairs of audio/high-frequency signal lines can resonate to function as a dipole antenna.

Additionally, for a signal having a fundamental frequency (for example, 100 MHz), the above-described loading coil has low impedance so that the two pairs of audio/high-frequency signal lines, each loading connected to the two pairs of audio/high-frequency signal lines, and a conductive line can function as a loop antenna and can resonate.

Therefore, the above-described components including the two pairs of audio/high-frequency signal lines form a loop antenna that resonates at a fundamental frequency (for example, 100 MHz) and further is excited with the higher harmonics of the fundamental frequency (a third harmonic: for example, 300 MHz, a fifth harmonic: for example, 500 MHz, and a seventh harmonic: for example, 700 MHz) and a dipole antenna that resonates with a signal of a specific frequency (for example, 200 MHz) higher than a predetermined frequency (for example, 100 MHz) and further is excited with a higher harmonic (a third harmonic: for example, 600 MHz). Thus, the earphone antenna can provide a receiver sensitivity characteristic having relatively less variation over a wide frequency range. Furthermore, in order to provide the receiver sensitivity characteristic, no sensitivity control operation is required.

In addition, a resonant antenna length reducing function of the loading coil can increase the receiver sensitivity for a low-frequency signal without increasing the antenna length.

Accordingly, even though the antenna length is relatively short, the receiver sensitivity characteristic having relatively less variation over a wide frequency range can be obtained. Furthermore, in order to obtain the receiver sensitivity characteristic, no sensitivity control operation for the earphone antenna is required.

Furthermore, according to the earphone antenna of the claim 5, since each of the above-described two pairs of audio/high-frequency signal lines and the loading coil function as audio signal transmission means for transmitting an audio signal to the left and right earphone units, the earphone unit and the antenna can be integrated into one.

Accordingly, the antenna can be used to receive a high-frequency signal over a wide frequency range and can also be used as means for transmitting a unit audio signal to the earphone. That is, a highly sensitive and wide frequency range antenna and the earphone unit can be integrated into one.

According to an earphone antenna of the claim 6, since a single-loop antenna which is a double-loop antenna in the claim 5 is employed, the effective antenna length can be doubled although the length of the audio/high-frequency signal lines is the same as that in the claim 5.

Accordingly, doing a high-frequency signal in a low frequency range is possible. An earphone antenna supporting, for example, a 50-MHz frequency band for the market in the USA can be manufactured in the same size as that of an earphone antenna, for example, for the market in Japan.

According to an earphone antenna of the claim 7, since audio signal blocking means is disposed in the conductive line, the audio signal blocking means can prevent an audio signal transmitted through a pair of audio/high-frequency signal lines from not going to the earphone and from leaking to the conductive line.

According to an earphone of the claim 8, since one of the two pairs of audio/high-frequency signal lines is at an angle of substantially 180° with respect to the other of the two pairs of audio/high-frequency signal lines at the sides thereof adjacent to the balun, the two pairs of audio/high-frequency signal lines resonate to function as a U dipole antenna for a high-frequency signal of the above-described specific frequency.

According to an earphone antenna of the claim 9, since one of the two pairs of audio/high-frequency signal lines is at an angle of substantially less than 180° with respect to the other of the two pairs of audio/high-frequency signal lines at the sides thereof adjacent to the balun, the two pairs of audio/high-frequency signal lines resonates to function as a V dipole antenna for a high-frequency signal of the above-described specific frequency.

According to an earphone antenna of the claim 10, high-frequency signal blocking means is provided between each earphone and the audio/high-frequency signal lines. The high-frequency signal blocking means has high impedance for a high-frequency signal so as to separate the each earphone from the audio/high-frequency signal lines for high frequencies, whereas the high-frequency signal blocking means has low impedance for an audio signal so as to allow the signal to pass therethrough. Consequently, the high-frequency signal blocking means can prevent high-frequency adverse effects on the antenna and a wireless device transmitted from the human body via the earphone.

According to an earphone antenna of the claim 11, since a frequency range expansion capacitor is connected between audio/high-frequency signal lines in each of the left and light pairs of the audio/high-frequency signal lines, the frequency characteristic of receiver sensitivity of the antenna can be expanded towards a low-frequency side.

According to an earphone antenna of the claim 12, since high-frequency blocking means that has high impedance for high-frequency signals is provided to an audio signal line which transmits an audio signal to the audio/high-frequency signal line, the leakage of a high-frequency reception signal from the audio/high-frequency signal line to the audio signal line can be prevented.

According to a wireless device of the claim 13, since the above-described earphone antenna is employed, the wireless device can also provide the advantages of the earphone antenna.

The invention claimed is:

1. An earphone antenna comprising:

a balun for changing a balanced mode to an unbalanced mode, one end of a pair of audio/high-frequency signal lines being connected to one terminal of the balun on the balanced side, the other end of the pair of audio/high-frequency signal lines being connected to the other terminal of the balun on the balanced side, the pair of audio/high-frequency signal lines being connected to a left earphone unit, another portion of the pair of audio/high-frequency signal lines being connected to a right earphone unit; and high-frequency signal blocking means disposed between the left and the right earphone units and the audio/high-frequency signal lines connected to the left and the right earphone units;

wherein the high-frequency signal blocking means has high impedance for high-frequency signals so as to virtually block the high-frequency signals and has low impedance for audio signals so as to allow the audio signals to pass therethrough.

2. The earphone antenna according to claim 1, wherein audio signal blocking means is disposed on the pair of audio/high-frequency signal lines at positions more distant than connection points between the pair of audio/high-frequency signal lines and the left and right earphone units from the balun.

3. A wireless device comprising:

an earphone antenna comprising a balun for changing a balanced mode to an unbalanced mode, one end of a pair of audio/high-frequency signal lines being connected to one terminal of the balun on the balanced side, the other end of the pair of audio/high-frequency signal lines being connected to the other terminal of the balun on the balanced side, the pair of audio/high-frequency signal lines being connected to a left earphone unit, another portion of the pair of audio/high-frequency signal lines being connected to a right earphone unit; and high-frequency signal blocking means disposed between the left and the right earphone units and the audio/high-frequency signal lines connected to the left and the right earphone units, wherein the high-frequency signal blocking means has high impedance for high-frequency signals so as to virtually block the high-frequency signals and has low impedance for audio signals so as to allow the audio signals to pass therethrough.

4. The wireless device according to claim 3, wherein audio signal blocking means is disposed on the pair of audio/high-frequency signal lines at positions more distant than connection points between the pair of audio/high-frequency signal lines and the left and right earphone units from the balun.

* * * * *